US007900893B2

(12) United States Patent
Teurlay et al.

(10) Patent No.: US 7,900,893 B2
(45) Date of Patent: Mar. 8, 2011

(54) ELECTRONIC CONTROL FOR WINCH TENSION

(75) Inventors: Lucas Teurlay, Amiens (FR); Stephane Breard, Oust-Marest (FR); Dominique Aubry, Hallencourt (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/273,218

(22) Filed: Nov. 18, 2008

(65) Prior Publication Data

US 2009/0127525 A1 May 21, 2009

Related U.S. Application Data

(60) Provisional application No. 60/989,193, filed on Nov. 20, 2007.

(51) Int. Cl.
*B66D 1/48* (2006.01)

(52) U.S. Cl. ..... 254/270; 254/269; 254/273; 254/277

(58) Field of Classification Search ..... 254/270, 254/273, 277, 269
See application file for complete search history.

(56) References Cited

U.S. PATENT DOCUMENTS

| | | | | |
|---|---|---|---|---|
| 3,507,478 | A | 4/1970 | Lewis | |
| 3,653,636 | A | 4/1972 | Burrell | |
| 3,753,552 | A * | 8/1973 | Barron | 254/270 |
| 3,801,071 | A * | 4/1974 | Barron | 254/267 |
| 3,838,836 | A * | 10/1974 | Asseo et al. | 244/137.4 |
| 3,917,230 | A * | 11/1975 | Barron | 254/270 |
| 4,708,301 | A * | 11/1987 | Kataoka | 226/44 |
| 4,750,430 | A * | 6/1988 | Morton et al. | 104/114 |
| 4,775,086 | A * | 10/1988 | Kataoka | 226/44 |
| 5,025,606 | A * | 6/1991 | McGinnis et al. | 52/745.17 |

FOREIGN PATENT DOCUMENTS

| | | | |
|---|---|---|---|
| DE | 2600564 | | 7/1977 |
| EP | 1070828 | | 10/2003 |
| EP | 1063163 | | 11/2007 |
| GB | 2142161 | | 1/1985 |
| JP | 41009217 | B1 | 5/1966 |
| JP | 55061598 | A | 5/1980 |
| JP | 59026896 | A | 2/1984 |
| JP | 4016617 | A | 1/1992 |
| WO | 2004048249 | | 6/2004 |
| WO | 2006077811 | A1 | 7/2006 |

* cited by examiner

*Primary Examiner* — Emmanuel M Marcelo
(74) *Attorney, Agent, or Firm* — Michael L. Flynn; David Hofman; Jody Lynn DeStefanis

(57) ABSTRACT

A method for controlling the tension in a spooled device disposed on a winch, comprises providing an input signal to a controller indicative of a measured tension in the spooled device, providing an input signal to the controller indicative of a desired tension in the spooled device, and providing an output signal from the controller to adjust the speed of the winch based on a difference between the desired tension in the spooled device and the measured tension in the spooled device.

18 Claims, 1 Drawing Sheet

ELECTRONIC CONTROL FOR WINCH TENSION

CROSS-REFERENCE TO RELATED APPLICATION

This application is entitled to the benefit of, and claims priority to, provisional patent applications 60/989,193 filed Nov. 20, 2007, the entire disclosure of which is incorporated herein by reference.

BACKGROUND

The statements in this section merely provide background information related to the present disclosure and may not constitute prior art. The system and method relate in general to wellbore cables.

Embodiments relate in general to winch tension control, such as for wireline cables and the like. A winch is used during oilfield operations to move a downhole tool up and down during logging measurement, such as during wireline operations. A tool is attached to the cable and lowered into the wellbore while the cable is spooled and/or unspooled on the drum. During conventional operations, the cable tension on the surface of the drum is a result of the type and length of the cable as well as the weight of the tool string attached to the cable. In conventional techniques, the tool enters the well due to gravity, wherein a winch operator controls the motion of the tool inside the well in manual mode.

Conventional gravity based logging technique can become a difficult, time consuming, at least potentially dangerous and sometimes impossible task when dealing with unconventional and/or deviated wellbore. Tough Logging Conditions (TLC) is a means of conveying a logging tool string when conventional gravity based wireline logging is not feasible. During a TLC operation, a wireline cable and toolstring is typically connected to the drillpipe or tubing and may be used with logging tools that are normally run on wireline. Control of the tension in the cable is essential for a successful TLC operation. A typical system used to control the cable tension is a hydraulic pressure limiting system, which may deliver poor performance, resulting in important tension peaks during speed variation (quick accelerations/stops). This uncontrolled increase of cable tension could lead to a situation where the weak point of the tool string could break, which would result in waste of time to repair, or in lose of the tool string.

It is always desirable to improve the operation of downhole tool winches and their associated spooled elements.

SUMMARY

A method for controlling the tension in a spooled device disposed on a winch, comprises providing an input signal to a controller indicative of a measured tension in the spooled device, providing an input signal to the controller indicative of a desired tension in the spooled device, and providing an output signal from the controller to adjust the speed of the winch based on a difference between the desired tension in the spooled device and the measured tension in the spooled device. Alternatively, the spooled device comprises a wireline cable. Alternatively, the spooled device comprises a winch cable. Alternatively, the spooled device comprises coiled tubing. Alternatively, the spooled device comprises an umbilical.

Alternatively, the measured tension is measured by a cable mounted tension device. The cable mounted tension device may provide the measured tension to the controller in real time. The cable mounted tension device may provide the measured tension to the controller via an amplifier. Alternatively, the desired tension is input by a potentiometer. Alternatively, the controller is a PID controller.

Alternatively, the winch is powered by a hydraulic pump and motor assembly and the output signal may be directly connected to the winch hydraulic pump electric displacement control. The hydraulic pump and motor assembly may be a positive displacement pump powered by a prime mover and driving the hydraulic motor. Alternatively, the winch is powered by an electric power winch system and the output signal may control the speed of the electric motor. The electric power winch system may be an electric motor connected to a source of electric power through a variable speed drive.

In an embodiment, a system for monitoring the tension of a spooled conveyance, comprises an assembly for driving a winch, a conveyance spooled upon the winch, and a controller having at least a measured tension input and a desired tension input, the controller operable to output a signal to adjust the speed of the winch based on a difference between the desired tension in the spooled device and the measured tension in the spooled conveyance. Alternatively, the spooled conveyance is one of a wireline cable and coiled tubing.

Alternatively, the assembly for driving the winch comprises an electric motor connected to a source of electric power through a variable speed drive. Alternatively, the assembly for driving the winch comprises a hydraulic motor connected to a positive displacement pump powered by a prime mover. Alternatively, the controller is a PID controller. Alternatively, the measured tension input is measured by a cable mounted tension device.

A method to control the tension of a conveyance or device spooled on a winch powered by a hydraulic or electric system, such as cable tension of a hydraulic or electric winch is disclosed. Embodiments comprise with a method to control the tension of a spooled conveyance or device on a hydraulic or electric winch, such as cable tension or the like.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
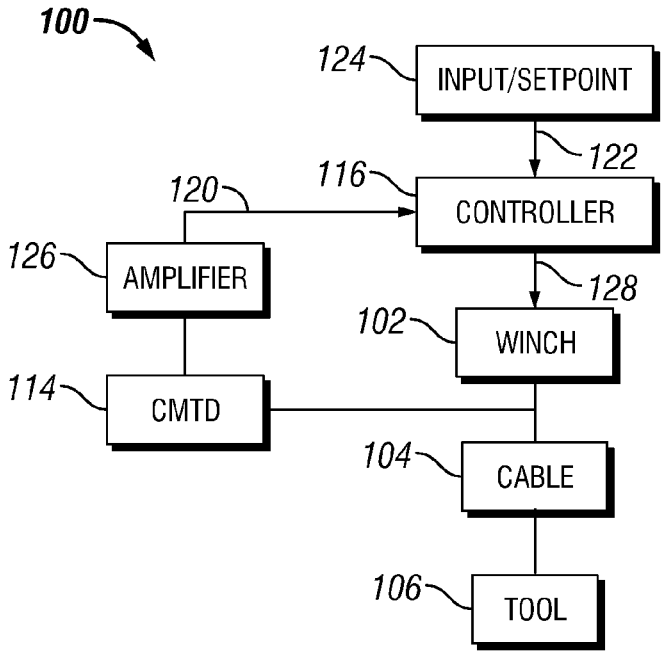
FIG. 1 is a schematic view of an embodiment of a hydraulic system utilizing electronic control of tension of a spooled device.
Figure 2:
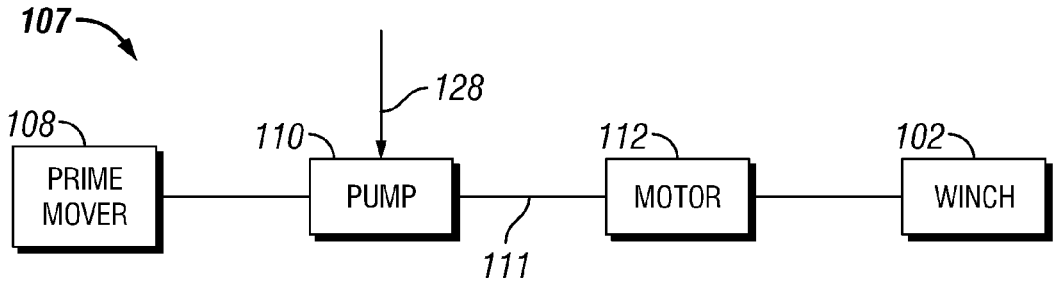
FIG. 2 is a schematic view of a hydraulic system controlled by the system of FIG. 1.

Referring now to FIGS. 1 and 2, an embodiment of a winch control system is indicated generally at 100. The system 100 comprises a winch 102 having a spooled device, such as, but not limited to a cable, 104 attached thereto. The spooled device 104 may be, but is not limited to, a winch cable, a wireline cable, coiled tubing, an umbilical, or the like. Attached to the spooled device 104 is a tool 106, such as a wireline logging tool, or the like. The winch 102 is powered by a hydraulic power system, indicated generally at 107 in FIG. 2, comprising a prime mover 108 powering a hydraulic pump 110, which is in communication with a source of hydraulic fluid (not shown). The prime mover 108 may be, but is not limited to, an internal combustion engine, such as a diesel engine or the like, an electric motor, or any prime mover suitable for powering the hydraulic pump 110, as will be appreciated by those skilled in the art. The hydraulic pump 110 supplies pressurized hydraulic fluid to a hydraulic motor 112, which in turn provides torque and/or power to the winch 102 to raise and/or lower the spooled device 104. The tension of the cable 104 is monitored by an in-line device, such as a cable mounted tension device (CMTD) 114.

The displacement of the hydraulic pump 110 is controlled by a controller 116, which uses a proportional-integral-derivative algorithm. The controller 116 receives an input 120 from the CMTD 114, preferably corresponding to a value of a tension in the cable 104, and an input 122, corresponding to a user input tension value from a suitable input or set point device 124, such a potentiometer or the like. The input 120 from the CMTD may be amplified by an amplifier 126, such as a load cell amplifier, a strain gage amplifier or the like. During operation, the operator (not shown) of the system 100 inputs a desired tension 124. Based on the desired input tension 124 and the actual input tension 120, the controller 116 generates an output 128 (discussed in more detail below) to control the winch 102.

The control of the system 100 is based on a closed loop PID regulation, which attempts to correct the error between a measured process variable (actual tension measured by the CMTD 114) and a desired set point (set by the input 124) by calculating and then outputting a corrective action via an output 128 that can adjust the process accordingly. In order to compute the corrective action to regulate the cable tension, the microcontroller or PID controller 116 has for inputs at least (a) the instruction or set point, wherein the operator sets the desired cable tension 122 and (b) the sensor, wherein the cable tension is monitored in real time by means of the Cable Mounted Tension Device (CMTD) 114. The Cable Mounted Tension Device (CMTD) is a known device used in standard wireline operations, and is used as a sensor to monitor in real time the logging cable tension. Alternatively, any suitable device for measuring the tension of the cable and transmitting a signal indicative of the tension may be utilized while remaining within the scope of the present invention.

With these two inputs 120 and 122, the microcontroller 116 sends a signal 128 to the Electric Displacement Control (EDC) of the pump 110, which corresponds to a corrective action. The output 128 of the controller 116 (the corrective action) is directly connected to the hydraulic pump 110 of the winch 102. In order to act on the cable tension, the corrective action or output 128 sends a current preferably directly proportional to an output flow 111 of the pump 110. The pump flow 111 is preferably directly proportional to the current of the signal 128 sent to the pump EDC. Thus the rotation speed of the drum is directly proportional to the current sent to the pump EDC. The flow 111 from the pump 110 will move the motor 112, and thus the drum (not shown) of the winch 102 in order to increase or decrease the tension on the cable 104, which is based on the inputs 120 and 122 into the controller 116.

Figure 3:
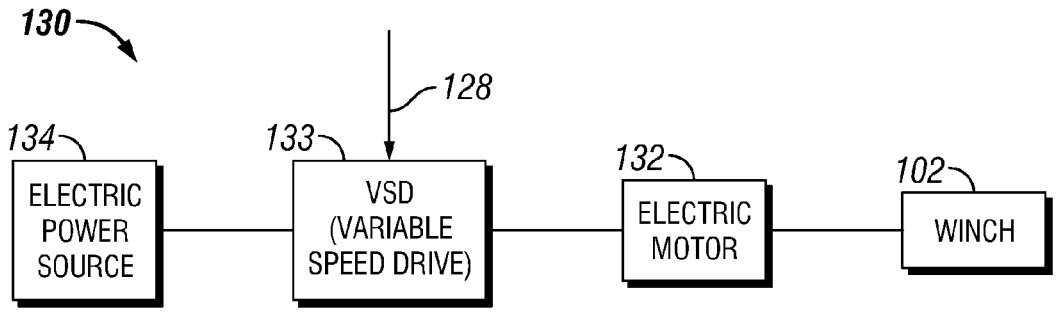
FIG. 3 is a schematic view of an electric system controlled by the system of FIG. 1.

Alternatively, the system 100 is utilized to control an electric power winch system, indicated generally at 130 in FIG. 3. In the system 130, the winch 102 is powered by an electric motor 132 that is preferably controlled by a variable speed drive 133, which receives electrical power from a suitable source 134 of electric power. The electric power source 134 may be a supply from the electric power grid (not shown), supplied from a generator or alternator driven by, an internal combustion engine or the like or provided by any suitable electrical power source. In the system 100 comprising the electric motor 132, the controller 116 sends the signal 128 to a controller of the variable speed drive 133 to control the speed of the motor and thus the winch 102.

This system 100 utilizes signals that are part of most winch control systems, advantageously allowing for the system 100 to be installed onto an existing winch 102 via simple retrofit kits by, for example, by installing the controller 116 and the sensor 114. The system 100 and method to control the tension on a spooled device 104, such as a winch cable, wireline, coiled tubing, an umbilical, or the like. The system 100 and method is a closed loop regulation based on a proportional-integral-derivative controller (PID). The system sends the corrective action 128 directly to the pump 110 by controlling the pump flow 111, and thus the drum movement. The system sends the proper control signal to the pump according to the monitored cable tension 120 (from the CMTD 114) and the desired cable tension 122 (input by a potentiometer 124).

Embodiments of the system and method regulate a winch cable tension and minimize at maximum the response time of the system. By minimizing this response time of the system, cable tension peaks during speed variations, and thus undesired cable breaks will also be advantageously reduced and/or minimized. The system 100 may be utilized during TLC jobs, meaning that the cable, such as the cable 104 and the tool string, such as the tool 106, are connected to the drill pipes, thus the tension into the cable between the drill pipes and the drum is controlled.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A method for controlling the tension in a spooled device disposed on a winch, comprising:

providing an input signal to a controller indicative of a measured tension in the spooled device, wherein the measured tension is measured by a cable mounted tension device;

providing an input signal to the controller indicative of a desired tension in the spooled device; and providing an output signal from the controller to adjust the speed of the winch based on a difference between the desired tension in the spooled device and the measured tension in the spooled device.

2. The method of claim 1 wherein the spooled device comprises a wireline cable.

3. The method of claim 1 wherein the spooled device comprises a winch cable.

4. The method of claim 1 wherein the spooled device comprises coiled tubing.

5. The method of claim 1 wherein the spooled device comprises an umbilical.

6. The method of claim 1 wherein the cable mounted tension device provides the measured tension to the controller in real time.

7. The method of claim 1 wherein the cable mounted tension device provides the measured tension to the controller via an amplifier.

8. The method of claim 1 wherein the desired tension is input by a potentiometer.

9. The method of claim 1 wherein the controller is a PID controller.

10. The method of claim 1 wherein the winch is powered by a hydraulic pump and motor assembly and wherein the output signal is directly connected to the winch hydraulic pump electric displacement control .

11. The method of claim 10 wherein the hydraulic pump and motor assembly is a positive displacement pump powered by a prime mover and driving the hydraulic motor.

12. The method of claim 1 wherein the winch is powered by an electric power winch system and wherein the output signal controls the speed of the electric motor.

13. The method of claim 12 wherein the electric power winch system is an electric motor connected to a source of electric power through a variable speed drive.

14. A system for monitoring the tension of a spooled conveyance, comprising:

an assembly for driving a winch;

a conveyance spooled upon the winch; and a controller having at least a measured tension input and a desired tension input, the controller operable to output a signal to adjust the speed of the winch based on a difference between the desired tension in the spooled device and the measured tension in the spooled conveyance, wherein the measured tension input is measured by a cable mounted tension device.

15. The system of claim 14 wherein the spooled conveyance is one of a wireline cable and coiled tubing.

16. The system of claim 14 wherein the assembly for driving the winch comprises an electric motor connected to a source of electric power through a variable speed drive.

17. The system of claim 14 wherein the assembly for driving the winch comprises a hydraulic motor connected to a positive displacement pump powered by a prime mover.

18. The system of claim 14 wherein the controller is a PID controller.

* * * * *